US008793911B2

(12) United States Patent
English

(10) Patent No.: US 8,793,911 B2
(45) Date of Patent: Aug. 5, 2014

(54) ROLLER BANNERS

(75) Inventor: Stuart English, Alnwick (GB)

(73) Assignee: Iconet Limited, Northumberland (GB)

( * ) Notice: Subject to any disclaimer, the term of this patent is extended or adjusted under 35 U.S.C. 154(b) by 0 days.

(21) Appl. No.: 13/502,227

(22) PCT Filed: Oct. 15, 2010

(86) PCT No.: PCT/EP2010/006304

§ 371 (c)(1),
(2), (4) Date: Jun. 21, 2012

(87) PCT Pub. No.: WO2011/045069

PCT Pub. Date: Apr. 21, 2011

(65) Prior Publication Data

US 2012/0260547 A1 Oct. 18, 2012

(30) Foreign Application Priority Data

Oct. 15, 2009 (GB) ..... 0918067.0
Sep. 7, 2010 (GB) ..... 1014822.9

(51) Int. Cl.
*G09F 15/00* (2006.01)

(52) U.S. Cl.
CPC ..... *G09F 15/00* (2013.01)
USPC ..... 40/610; 40/603; 40/604

(58) Field of Classification Search
USPC ..... 40/517, 603–605, 610, 600, 624, 729, 40/730, 594, 514; 160/24, 120, 135, 180, 160/263, 349.1, 368.1; 242/206.5, 378, 242/378.4, 388.6
See application file for complete search history.

(56) References Cited

U.S. PATENT DOCUMENTS

| | | | | |
|---|---|---|---|---|
| 5,798,861 | A * | 8/1998 | Doat | 359/461 |
| 6,115,951 | A * | 9/2000 | Jing et al. | 40/610 |
| 7,040,372 | B2 * | 5/2006 | Johansson et al. | 160/24 |
| 7,237,350 | B1 * | 7/2007 | Zarelius | 40/610 |
| 7,716,860 | B1 * | 5/2010 | Burris | 40/514 |
| 7,773,298 | B2 * | 8/2010 | Miyagawa et al. | 359/443 |
| 7,963,059 | B2 * | 6/2011 | Fritsche et al. | 40/603 |
| 8,028,449 | B2 * | 10/2011 | Zarelius | 40/610 |
| 8,272,156 | B2 * | 9/2012 | Gimpel et al. | 40/604 |
| 8,322,060 | B2 * | 12/2012 | Parizek et al. | 40/610 |
| 2008/0005945 | A1 | 1/2008 | Fritsche et al. | |
| 2009/0056184 | A1 | 3/2009 | Fritsche et al. | |

FOREIGN PATENT DOCUMENTS

| | | | |
|---|---|---|---|
| CN | 2452079 | | 10/2001 |
| DE | 19802114 | A1 | 8/1999 |
| EP | 0635753 | A1 | 1/1995 |
| GB | 2358511 | A | 7/2001 |
| WO | 01/35381 | A1 | 5/2001 |
| WO | 2008/061425 | A1 | 5/2008 |

OTHER PUBLICATIONS

Search Report for GB 1017528.9 dated Feb. 4, 2011.
Search Report and Written Opinion for PCT/EAP2010/006304 dated Feb. 8, 2011.

* cited by examiner

*Primary Examiner* — Charles A Fox
*Assistant Examiner* — Shin Kim

(57) ABSTRACT

A presentation banner system is provided which allows multiple banners to be provided side by side to provide a continuous display without gaps between adjacent banners. The banner is stored in a roller in a container the container being longer than the roller and the banner being the same length as the container and the ends of the container are provided with means for attachment of neighboring containers to each other.

20 Claims, 4 Drawing Sheets

10
2
1

12

11
5
3
4
8
6
7
9

5
6
3
10

5
3
10

3
5
10
4

3
7
8
9
4

5

3
7
10

ROLLER BANNERS

CLAIM OF PRIORITY

This application is a national application based on PCT Application No. PCT/EP2010/006304, filed Oct. 15, 2010, which claims benefit of GB0918067.0, filed Oct. 15, 2009 and GB1014822.9, filed Sep. 7, 2010, which are both hereby entirely incorporated by reference for all purposes.

The present invention relates to improvements in or relating to roller banners.

Roller banners are frequently used for promotional activities and consist of advertising or promotional material contained on a banner which, when out of use, is rolled up within a container, usually a cylindrical container to provide an easily transportable item.

In use the banner may be unrolled to expose the promotional material often vertically upwards from the container and is held in place in the viewing position by a retaining means such as a supporting bar. The banner may be spring biased so that when the retaining means is removed the banner will return to the rolled position within the container.

Roller banners provide a common mechanism for storing, transporting and quickly erecting a graphic panel for display purposes.

They typically consist of a sprung roller mechanism held at each end by a plate that forms part of the casing. The spring acts on the plate to create a rotational force on the roller thus when the banner graphic is released from its support it is automatically retracted around the roller.

Banners of this nature are often used at stands at exhibitions, for the provision of advertising materials, in shops and shopping centres and for the display of information in public places and at special events.

A problem with current roller banners is that it is not possible to link banners together without there being a gap between the edges of adjacent banners because the location of the end plates at the end of the rollers in each of the units requires there to be a gap between one banner and the next. It is not therefore possible to provide a continuous display across two or more banners.

The present invention therefore provides the ability to display with self-rolling banners, the ability to join multiple banners side by side to produce a larger continuous display.

The design is portable, easy to use, and the base unit in which the presentation is stored becomes the base unit of the banner.

The invention therefore provides a banner system comprising a roller mounted within a base unit and a banner releasably rolled around the roller wherein the length of the roller is less than the length of the base unit and the width of the banner is the same as the length of the base unit wherein at least one end of the base unit is provided with an engagement means whereby it can be attached to a second banner system.

The invention further provides two or more such banner systems attached to each other.

The invention further provides two or more of such banner systems attached to each other with the banners in their presentation position.

The invention therefore provides a banner system whereby it is possible for multiple banner systems to be connected side by side without gaps between the banners when they are in the presentation position to produce a larger widescreen display. The ends of the base units interlock, with the presentation banner extending further than the edges of the central roller so that the base units can be pushed together to interlock once the presentations are unrolled and fully extended.

Usually base units are pushed together horizontally. After use of the banner, the base units should be detached before retracting the banners from each other. Once the base units are separate the banner may be retracted by pulling the top of the banner up slightly so that it automatically rolls back into the base unit under the power of a retaining coil.

The means for attachment of the base units may be a simple sliding fit or a locking attachment. In a preferred embodiment there is no additional mechanical means required to attach the base units together. They may however be held together magnetically providing a force strong enough to hold them together but which allows them to be readily separated.

The base units are also containers for the roller and they preferably have a flat base to provide stability in use and are provided with a protrusion at least one end, the protrusion on a first banner system being shaped so that it can receive a protrusion provided on a second banner system for the attachment together of the two systems. In a preferred embodiment the container component of the base unit is cylindrical and provided with a slot for removal and retraction of the banner from and onto the roller. The protrusions at one end of the container may extend partially around the circumference of the container and the second system may be provided with a protrusion shaped to fit into the space provided by a gap in the protrusion around the circumference of the first container to enable the containers to be assembled together.

In a preferred embodiment a first end of the base unit is provided with one attachment means and a second end of the base unit is provided with the means to locate with an attachment means on another base unit corresponding to the attachment means at the first end. This allows a series of banner systems can be assembled with each other in a linear fashion to provide a continuous display derived from a plurality of banners.

A preferred banner system according to the invention comprises i) a roller to which the presentation banner may be secured and releasably wound around.

ii) a spring based coiling mechanism which will act to retract the banner when it is released from its presentation position.

iii) a support to retain the banner in its presentation position.

iv) a base unit for containing the roller and the spring based coiling mechanism the base unit being provided with a slot for withdrawal of the banner from the roller into the presentation position or retraction of the banner back onto the roller for storage and transportation.

The base unit preferably has a flat base to hold the banner steady when in the presentation system; and has a cylindrical section to house the roller with the banner around it when it is in the storage position. The container is provided with attachment means at each end, the attachment means at the first end being shaped to engage with the attachment means at the second end so that two or more base units may be integrated with each other. The support means for holding the banner in the presentation mode is preferably releasably attached to the base unit typically to the centre of the base unit but can be removed from the base unit for storage and transportation. The support means can, if desired, be telescopic.

According to the invention the base unit including protrusions acting as engagement means is longer than the roller and the width of the banner is substantially the same as the length of the base unit. In this way two (or more) base units may be assembled together without the rollers of the units interfering with each other and the banners may be brought into the presentation mode independently of each other with their edges touching to provide a continuous display bridging two or more banners.

The invention further allows the material of individual banners to be interchanged without the need to disrupt the entire display.

When preparing the presentation the individual banners must be rolled out into viewing position before the neighbouring banner units are connected to each other. Similarly linked banner units must be separated before the banners can be retraced onto the sprung roller. This is because, in order to get the base units to link, the space used by the rolled up banner beyond the length of the roller when in the storage position must be free to receive the attachment means of the neighbouring base unit.

In a further embodiment one or both edges of the banner are provided with a strip of adhesive to improve and control the winding and unwinding of the banner. In particular the edge of the banner may be provided with a magnetic strip of appropriate size and strength to ensure that the banner can be rolled within the casing on the roller in a compact manner and can also be readily released there from. The banners may also be provided with strips at their edges to hold them together in the mounted position. For example magnetic strips may be provided.

The invention is illustrated by reference to the accompanying drawings in which

Figures 1A, 1B, 1C, 1D:
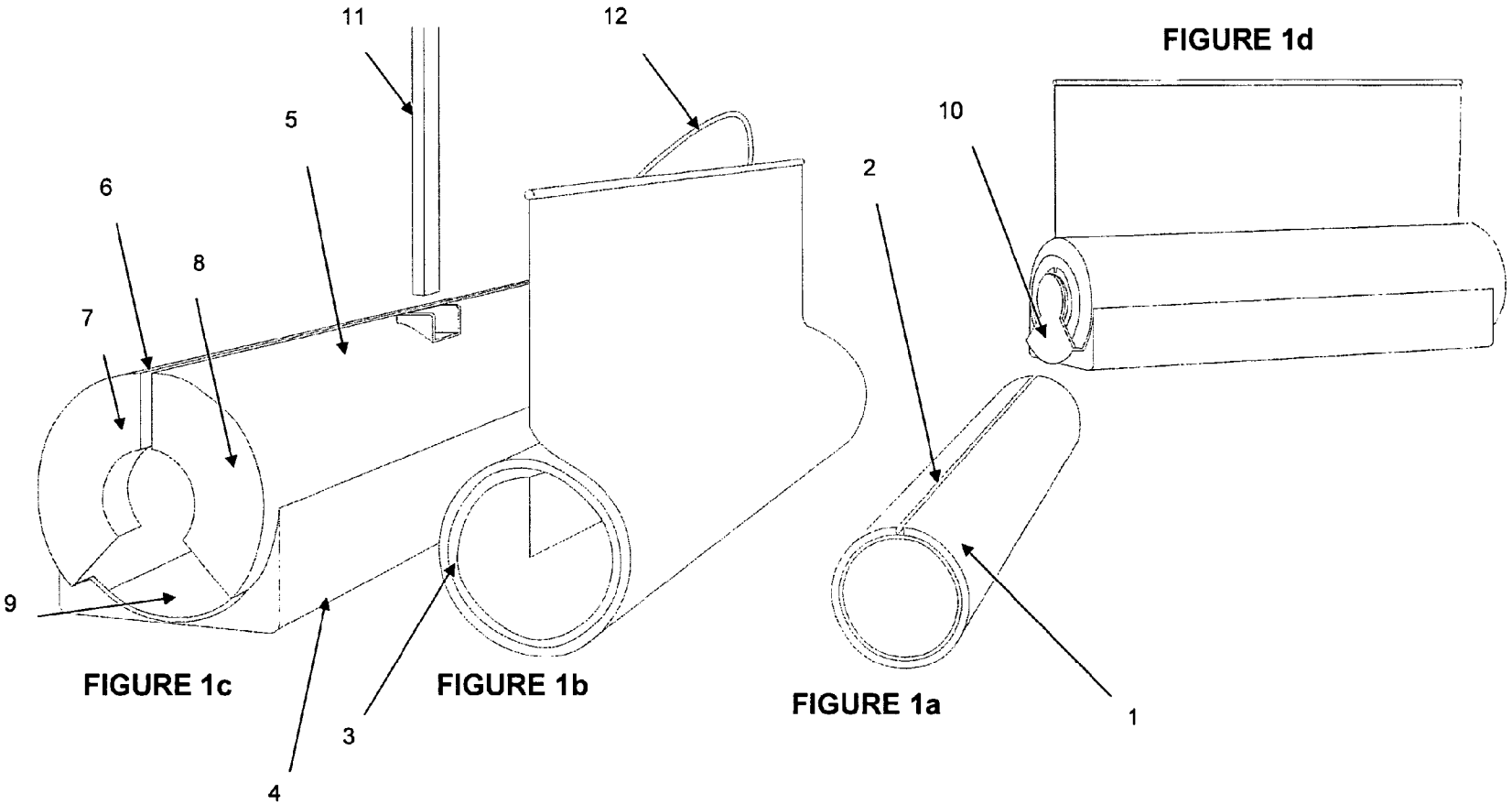
FIG. 1 shows the components of a banner system according to the invention.

FIG. 1*a* shows a central roller (1) provided with a slot (2) to which a banner can be attached.

FIG. 1*b* shows a banner (3) in the rolled position as if it was retained by the roller.

FIG. 1*c* shows a base unit provided with a flat base (4) containing a cylindrical housing (5) provided with a slot (6) through which the banner (3) can pass.

The base unit is provided with a protrusion (7) and (8) which provide a means of assembly to a matching protrusion (9) in a second base unit. It is also preferred that a matching protrusion be provided at the other end of the container as shown by (10) in FIG. 1*d*. FIG. 1*c* also shows the support (11) that may be used to hold the banner in the presentation position by linking the loop (12) shown in FIG. 1(*b*) over the top of the support (not shown). The banner is biased back into the container and around the roller by a spring coiling mechanism (not shown).

FIG. 2 shows various elevations of the base unit shown in FIG. 1(*c*) and like numerals are used for the like items in FIG. 1.

Figures 2A, 2B, 2C, 2D, 2E, 2F:
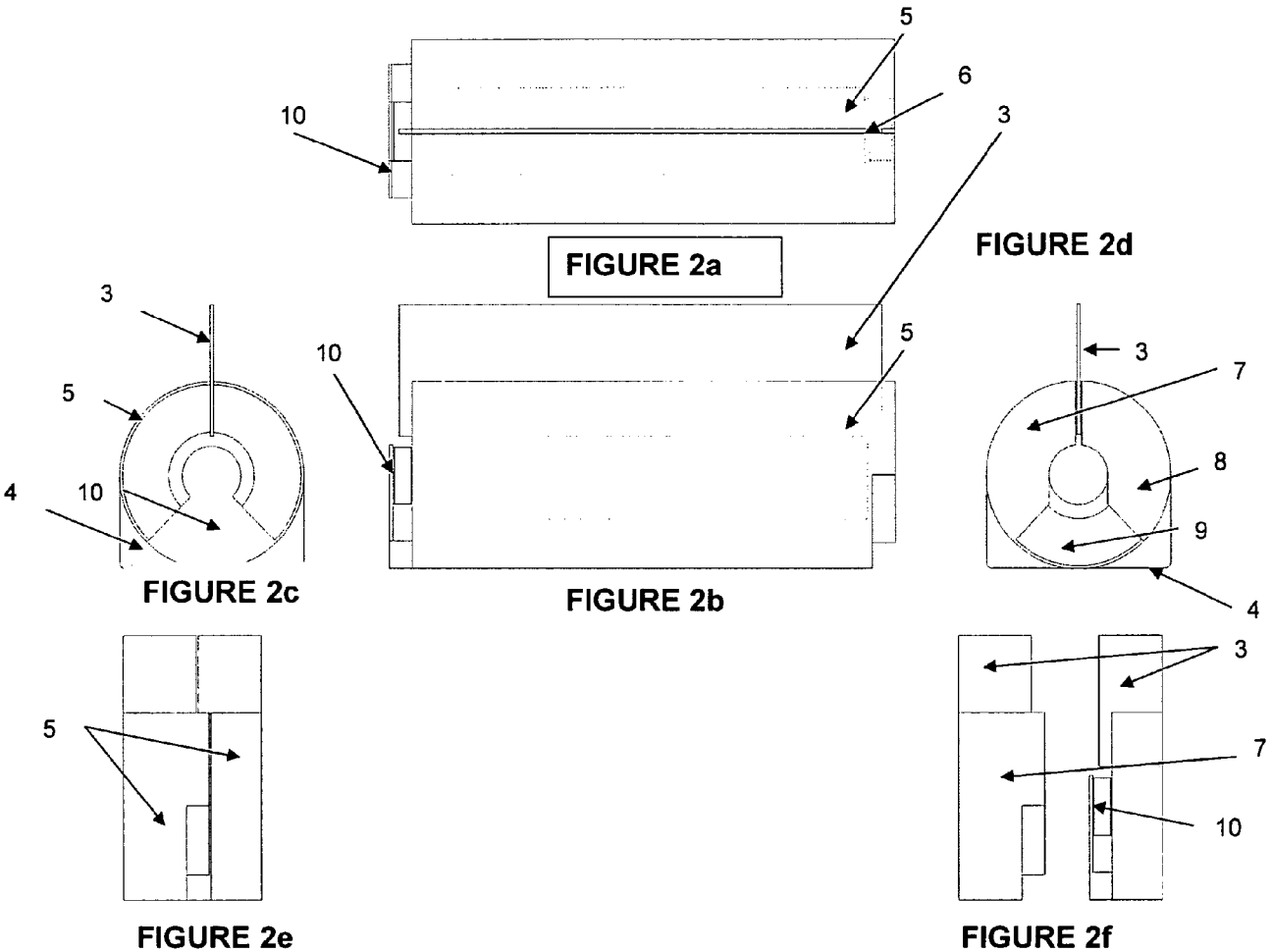
FIG. 2 shows the attachment mechanism provided on a base unit of a banner system shown in FIG. 1

FIG. 2*a* is a top elevation of the housing, FIG. 2*b* is a front elevation of the housing. FIG. 2*c* is a left handed end view of the housing. FIG. 2*d* is a right hand end view of the housing. FIG. 2*e* shows two housings interlinked with each other and FIG. 2*f* shows interlinkable housings detached from each other.

Figure 3A:
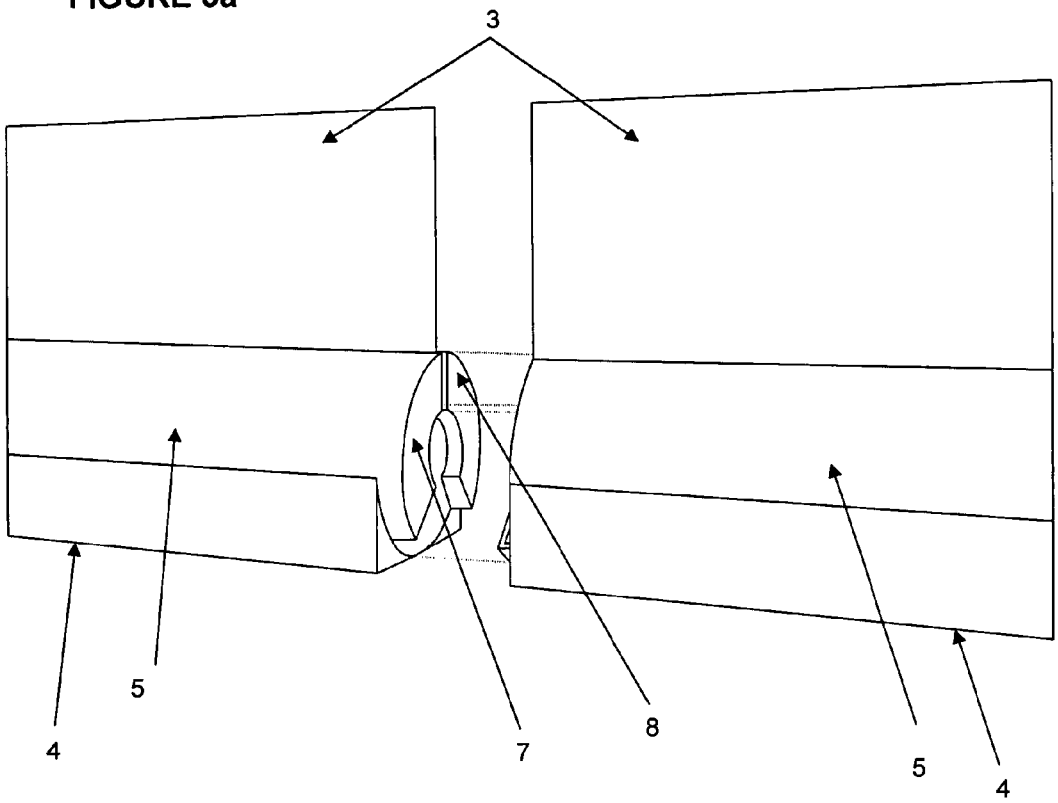
FIG. 3 shows two banner systems of the type shown in FIGS. 1 and 2 ready for assembly and attached to each other with the banners in the presentation position.

FIG. 3*a* shows two banner systems as shown in FIG. 1 adjacent to each other and ready to extend the banner into the presentation position and ready for assembly.

Figure 3B:
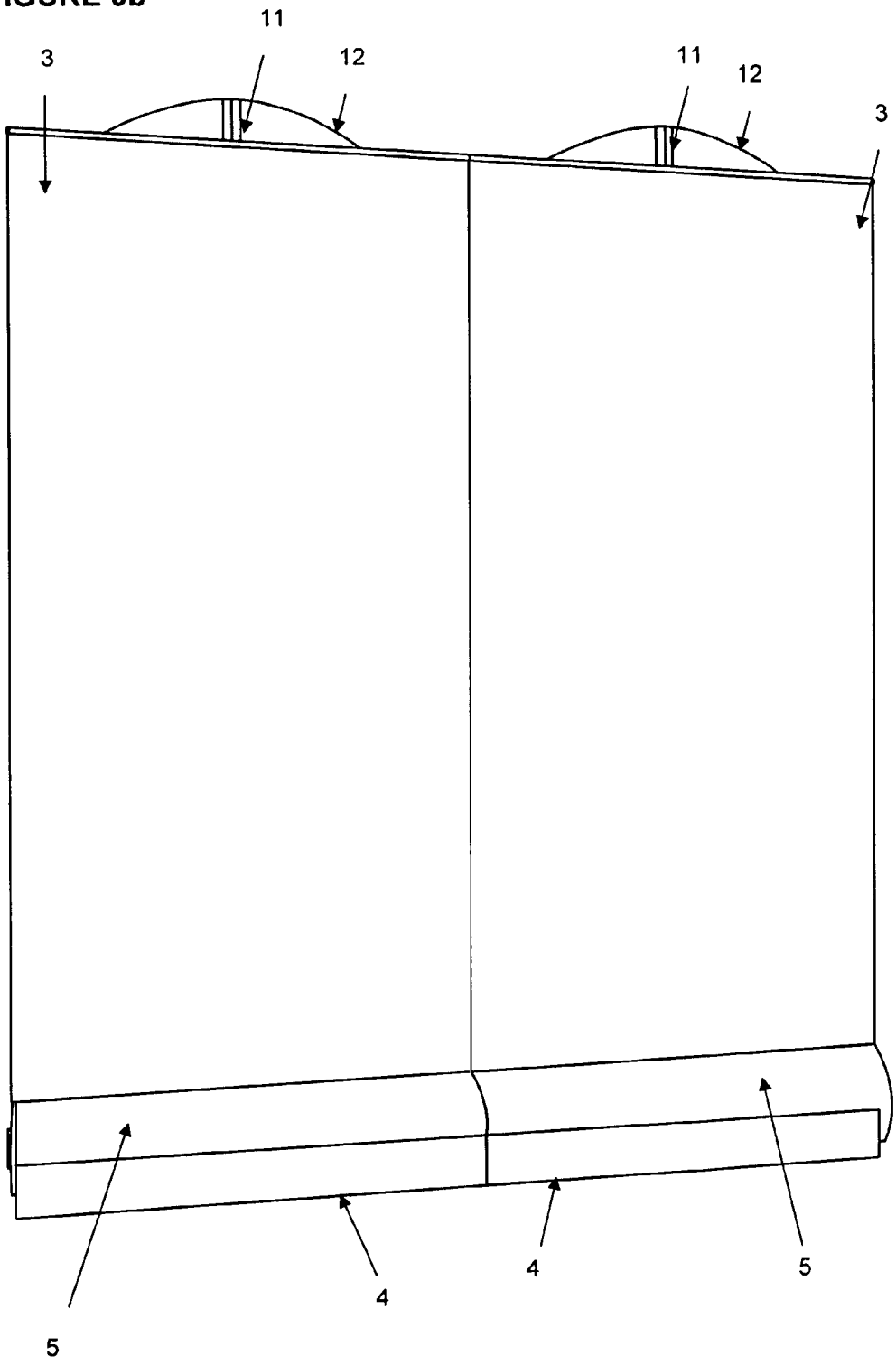

FIG. 3*b* shows the two banner systems of FIG. 3*a* with the banners extended and two of the banner systems assembled together.

The invention claimed is:

1. A banner system comprising:

a roller mounted within a base unit and a first banner releasably rolled around the roller wherein the, base unit is longer than a length of the roller and a length of the base unit equals a width of the first banner, wherein a first end of the base unit contains a cavity beyond the length of the roller, the cavity accommodates the first banner when the first banner is rolled into the base unit, and the cavity can accommodate engagement means of a second banner system once the first banner is unrolled into viewing position and a second end of the base unit contains an engagement means shaped to fit in a cavity within a base unit of a third banner system, wherein edges of the first banner and a second banner touch each other to provide a continuous display once the first and the second banners are unrolled.

2. A banner system according to claim 1 in which the base unit includes a cylindrical component which contains the roller.

3. A banner system comprising two or more banner systems according to claim 1 assembled together.

4. A banner system according to claim 1 in which the engagement means of the base units is a sliding fit or a locking attachment.

5. A banner system according to claim 1 in which the ends of the base units interlock, once the banners are unrolled and fully extended.

6. A banner system according to claim 1 in which the base units have a flat base and are provided with a protrusion on at least one end, the protrusion on the first banner system being shaped so that it can receive a protrusion provided on the second banner system for attachment together of the first banner system and the second banner system.

7. A banner system according to claim 6 in which the base units include a cylindrical component which contains the roller and in which the protrusions are formed on the cylindrical component.

8. A banner system according to claim 1 wherein there are no gaps between the edges of the banners in viewing position.

9. A banner system according to claim 1 in which the base units are held together magnetically.

10. A banner system according to claim 1 comprising i) a roller to which a presentation banner may be secured and releasably wound around, ii) a spring based coiling mechanism which will act to retract the banner when it is released from its presentation position, iii) a support to retain the banner in its presentation position, iv) a base unit comprising a cylindrical section for containing the roller and the spring based coiling mechanism, the cylindrical section being provided with a slot for withdrawal of the banner from the roller into the presentation position or retraction of the banner back onto the roller wherein the base unit has a flat base wherein the base unit is provided with engagement means at each end, the engagement means at the first end being shaped to engage with the engagement means at the second end so that two or more base units may be assembled together.

11. A banner system according to claim 10 wherein the engagement means is part of the cylindrical section.

12. A banner system according to claim 10 wherein the support means for holding the banner in the presentation mode is releasably attached to the base unit.

13. A banner system according to claim 10 wherein one or both edges of the banner are provided with a strip of adhesive.

14. A banner system according to claim 13 in which the one or both edges of the banner are provided with a magnetic strip.

15. A process for providing a display comprising at least two banner systems according to claim 1 wherein the individual banners are rolled out into viewing position and the neighbouring banner units are then assembled together in a linear fashion by interlocking the ends of the base units.

16. A banner system according to claim 1 wherein the engagement means are arranged to allow the banner to be connected to a second banner system in a linear fashion.

17. A banner system according to claim 3 wherein the engagement means of two of more base units of the two or more banner systems are connected in a linear fashion.

18. A banner system according to claim 1 wherein the engagement means comprises an interlock capable of engaging the second banner system wherein the interlock is disposed at the end of the base unit.

19. A banner system according to claim 18 wherein the engagement means comprises a sliding fit or a locking attachment.

20. A banner system according to claim 1 wherein the base unit is cylindrical wherein the engagement means comprises a protrusion at one end of a container which extends around circumference of the container and forms a gap and at the other end of the base unit comprises a protrusion shaped to fit into a gap the size of the gap on the first end.

* * * * *